United States Patent [19]

Ishida et al.

[11] Patent Number: 4,735,197

[45] Date of Patent: Apr. 5, 1988

[54] HYDRAULIC LASH ADJUSTER

[75] Inventors: Yoichi Ishida; Takashi Kanbe, both of Saitama, Japan

[73] Assignee: Honda Giken Kogyo Kabushiki Kaisha, Tokyo, Japan

[21] Appl. No.: 888,756

[22] Filed: Jul. 22, 1986

[30] Foreign Application Priority Data

Jul. 22, 1985 [JP] Japan ..... 60-161476
Jul. 22, 1985 [JP] Japan ..... 60-112168[U]

[51] Int. Cl.[4] ..... F01L 1/24
[52] U.S. Cl. ..... 123/90.58; 123/90.55
[58] Field of Search ..... 123/90.55–90.59, 123/90.46

[56] References Cited

U.S. PATENT DOCUMENTS 2,547,798 4/1951 Truxell, Jr. ..... 123/90.59
2,654,356 10/1963 Oldberg ..... 123/90.59
4,541,373 9/1985 Ishida ..... 123/90.55

FOREIGN PATENT DOCUMENTS 1011666 9/1952 Fed. Rep. of Germany ... 123/90.55
141915 11/1979 Japan ..... 123/90.57

*Primary Examiner*—Tony M. Argenbright
*Attorney, Agent, or Firm*—Lyon & Lyon

[57] ABSTRACT

A hydraulic lash adjuster of the closed-type including a closed cylinder with a plunger positioned therein defining a hydraulic chamber at the closed end of the cylinder. An annular diaphragm extending between the cylinder and the plunger as a reservoir. A passage provides communication between the reservoir and the hydraulic chamber with a check valve preventing flow from the hydraulic chamber to the reservoir. A passageway extends axially through the plunger and is closed off by means of a soft plug in an area of greater diameter intermediate the ends of the passageway. Retainers hold the annular diaphragm in place with the retainer associated with the plunger extending inwardly to the plunger within the diaphragm to conserve on axial length of the mechanism.

3 Claims, 2 Drawing Sheets

HYDRAULIC LASH ADJUSTER

BACKGROUND OF THE INVENTION

The field of the present invention is lash adjusters for engines and particularly for the valve train thereof.

Lash adjusters of the disclosed type are known to employ a cylinder, closed at one end, in which a plunger is slidably arranged. A compression chamber is defined at the closed end of the chamber where a spring biases the plunger towards the open end of the cylinder. A passage is known to be formed through the plunger which passage is controlled at one end by a one-way valve and is permanently closed off at the other end. Side passages extend to an annular reserve chamber defined by a diaphragm sealed at a first end to the plunger and at a second end to the cylinder.

It has been the practice to insert a hard ball into the passage for closure of the one end. The ball has been mechanically driven into an interference fit to form an appropriate seal. One problem associated with this is that the hard material of the ball at its initial insertion and thereafter may act to cause failure. This can occur as the result of stress concentrations in fabrication. The end result may be a seal failure or the introduction of metal powder into the mechanism which otherwise eventually will result in failure as well.

The area available in engines for valve mechanisms is generally at a premium. Heretofore, a substantial amount of room has been necessary for location of the annular reservoir of the hydraulic lash adjuster. This room extends the axial length of the overall adjuster even though there is no specific need for the added length for purposes of the adjuster stroke. The area needed for the reservoir is taken up by both the annular diaphragm and by extensions of the retainers located at either end thereof.

SUMMARY OF THE INVENTION

The present invention is directed to an improved hydraulic lash adjuster of the closed type. In a first aspect of the present invention, a passage way in the plunger of such an adjuster is permanently closed off by means of a material softer than that of the plunger itself. The material is positioned within an area of increased diameter within the passage way and deformed such that it fills that increased diameter. Through this means, stress is not concentrated and there is little opportunity for failure of the wall of the plunger where the soft material is placed.

In another aspect of the present invention, the retainer associated with the annular diaphragm at the plunger on a closed-type lash adjuster is arranged such that it extends from the annular diaphragm to the plunger inwardly of the annular diaphragm. Consequently, the increased height of the retainer extending from the diaphragm as, in prior devices, is avoided. Consequently, the overall length of the lash adjuster may be reduced.

Accordingly, it is an object of the present invention to provide an improved closed-type lash adjuster. Other and further objects and advantages will appear hereinafter.

DETAILED DESCRIPTION OF THE PREFERRED EMBODIMENTS

Figure 1:
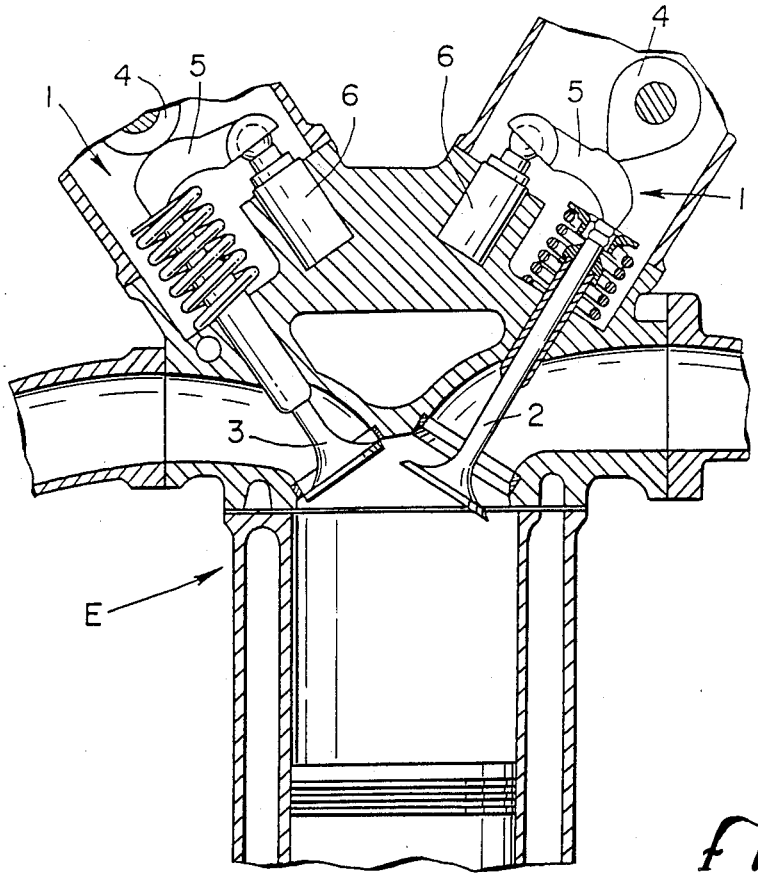
FIG. 1 illustrates closed-type lash adjusters associated with the valve train of an engine.

Turning in detail to the drawings, FIG. 1 illustrates an engine E employing kinetic valve mechanisms 1 to control an intake valve 2 and an exhaust valve 3. Each mechanism includes a cam 4 which rotates to actuate a rocker arm 5 which pivots on a lash adjuster 6 to actuate the valve. The lash adjuster 6 is shown to be positioned within the head of the engine to support the loads imposed by the rocker arm 5 during operation.

Figure 2:
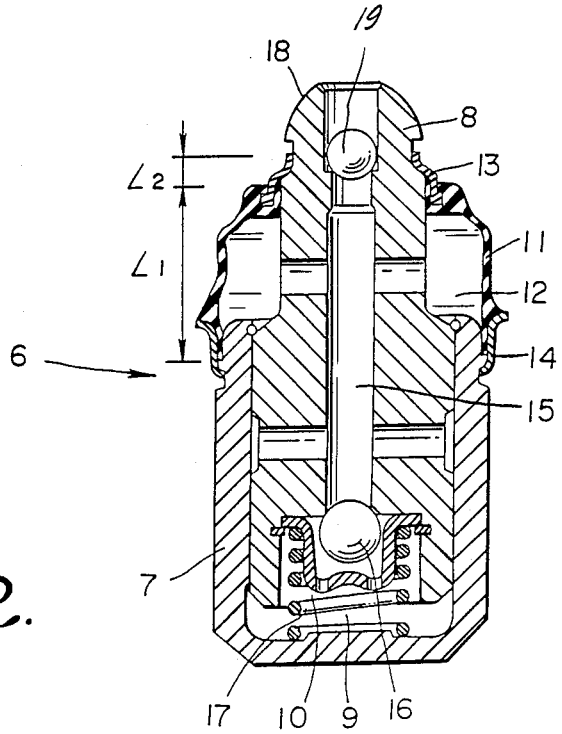
FIG. 2 illustrates a prior closed-type lash adjuster seen in vertical section and not including the features of the present invention.

Looking next to FIG. 2, a prior device is illustrated. The closed type hydraulic lash adjuster includes a body 7 defining a cylinder which is closed at one end. Positioned within the body 7 is a plunger 8 which is able to slide up and down within the cylinder. The body 7 and the plunger 8 define a hydraulic chamber 9 at the closed end of the body 7.

A recess is located in the lower end of the plunger 8 to accomodate certain equipment including a cup 10.

At the upper end of the adjuster is an annular diaphragm 11 positioned about the plunger 8 and the cylinder or body 7. The diaphragm 11 is sealed to the plunger at a first end by a retainer 13 and to the cylinder 7 at its other end by means of a second retainer 14. A first passageway 15 extends axially through the full length of the plunger 8. A second passageway extends across the first passageway 15 in a transverse manner. Thus there is a connecting passage from the hydraulic chamber 9 through the reservoir 12 defined by the annular space between the surface of plunger 8 and the diaphragm 11. Controlling one end of the passageway 15 is a one-way valve defined by a ball 16 positioned within the cup 10. The ball 16 sits against a shoulder in the passageway 15. The cup has a concavity at the lower end thereof to hold the ball in an appropriate position. Ports through the cup allow flow without significant restriction. A spring 17 biases the plunger toward the open end of the cylinder 7.

At the upper end of the plunger 8 is a spherical support portion 18 which receives one end of the rocker arm 5. An area of increased diameter at the upper end of the passageway 15 receives a hard metal ball 19. The ball 19 is typically harder than the material of which the plunger is made. To permanently close off one end of the passageway 15, it has been a practice to force the ball 19 into interference with the passageway 15 below the area of increased diameter. This can result in stress concentrations leading to eventual failure.

Figure 3:
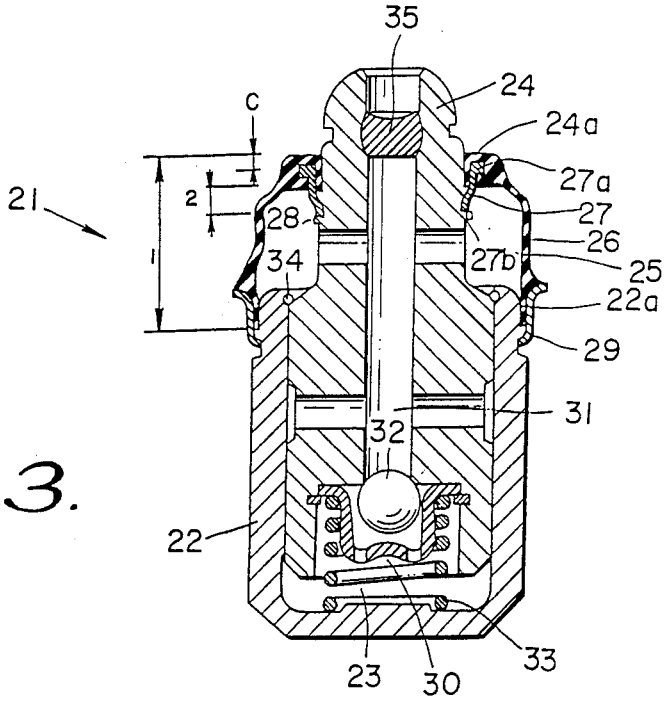
FIG. 3 is a cross-sectional elevation of a lash adjuster of the present invention.

Turning to FIG. 3, the present invention is illustrated. A lash adjuster 21 is shown to include a plurality of elements similar to that of FIG. 2 including a body 22 forming a closed cylinder to receive a sliding plunger 24, thereby defining a hydraulic chamber 23 at the closed end of the cylinder. A reservoir 25 is defined within an annular diaphragm 26. In this embodiment of FIG. 3, a retainer 27 is employed which differs from that of the device of FIG. 2. It can be noted that the retainer 27 extends into the interior of the annular diaphragm 26 rather than extending outwardly to the plunger 24. In this way, the additional length $L_2$ as seen in FIG. 2 is placed inwardly of the dimension of $L_1$ as seen in FIG. 3. The retainer 27 is shown to include anchoring means 27*a* for cooperating with the diaphragm 26. A lower member 27*b* of the retainer 27 fits within a groove defined in part by a lower flange 28 on the plunger 24. The upper end of the diaphragm then fits against a cylindrical portion 24*a* of the plunger. The lower retainer 29 is arranged in a conventional manner with the diaphragm 25 pressed against a cylindrical portion 22*a* of the body 22.

Located within the hydraulic chamber 23 is a cup 30 at the end of a passage 31 extending through the plunger. The passage 31 is controlled by a one-way valve employing a ball 32. A bias spring 33 biases the plunger 24 toward the open end of the body 22 with maximum movement of the plunger being restricted by a retainer ring 34.

Figure 4:
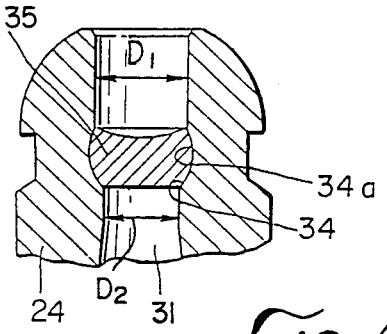
FIG. 4 is a detailed of the plug area of the lash adjuster of FIG. 3 shown in vertical section.
Figure 5:
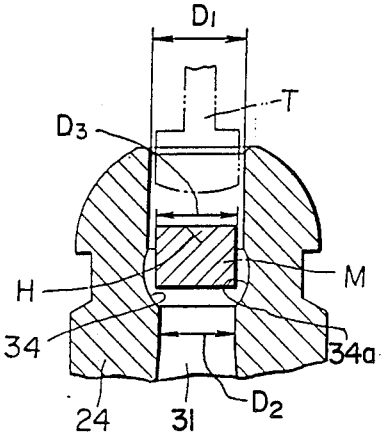
FIG. 5 is a detailed of the plug area of the lash adjuster of FIG. 3 also shown in vertical section and prior to the placement of the plug.

At the upper end of the passage way 31, a soft plug 35 is arranged to seal off the passageway. Reference is made to FIGS. 4 and 5 for the details of this arrangement. The passageway 31 includes an area 34*a* of large diameter. A plug is shown located in sealed arrangement in FIG. 4 in this enlarged diameter 34*a*. As shown in FIG. 4, the diameter $D_1$ is shown to be larger than the diameter $D_2$. The area of greatest diameter is approached at 34*a* where a rounded inner surface defines the area of greater diameter intermediate the ends of the passageway 31.

Looking at FIG. 5, a blank plug M is shown to be positioned in the passageway 31. The plug M has a diameter $D_3$ which is greater than the diameter $D_2$ but less than the diameter $D_1$. Consequently, the plug M may be placed in position without it proceeding down the passage. A hollow or depression H is arranged at the top of the plug to aid in the deformation thereof. A tool T is shown in phantom which may be brought into the passageway 31 to deform the plug M such that it results in the final plug as seen in FIG. 4.

Figure 6:
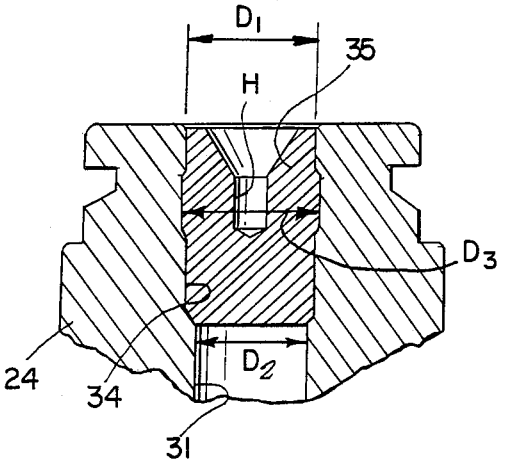
FIG. 6 is another embodiment of the present invention illustrating a similar area to that of FIGS. 4 and 5.

Looking at FIG. 6, a similar mechanism is employed. Again, a first diameter $D_1$ allows placement of a soft plug. A smaller diameter $D_2$ retains the plug from moving through the passage from the area of increased diameter 31*a*. A plug is in position which is able to be fit into the area upwardly of the smallest diameter $D_2$ and deformed.

It is advantageous to employ a plug of softer material than the plunger as discussed above. Albeit many materials are available, it has been found that a plunger of SCr415H may be employed with plunger material of S15C to S45C.

Thus, an improved closed-type hydraulic lash adjuster is disclosed. While embodiments and applications of this invention has been shown and described, it would be apparent to those skilled in the art that many more modifications are possible without departing from the inventive concepts therein. The invention, therefore, is not to be restricted except in the spirit of the appended claims.

What is claimed is:

1. A closed type hydraulic lash adjuster comprising a cylinder closed at one end;

a plunger slidably arranged in said cylinder to define a compression chamber at said closed end;

an axial passageway extending through said plunger, said passageway including a first portion at the outer end thereof, a second portion axially spaced from said first portion having a diameter less than that of said first portion, and a third portion intermediate said first and second portions having a diameter greater than that of said first and second portions; and a plug of softer material than that of said plunger, said plug having an original lateral dimension less than the diameter of said first passageway portion and greater than the diameter of said second passageway portion, said plug being deformed in said passageway to substantially fill said third passageway portion.

2. The closed type hydraulic lash adjuster of claim 1 further comprising a resilient annular diaphragm about said plunger and said cylinder, a first annular retainer fixed to one end of said annular diaphragm and to said plunger and a second annular retainer fixed to the other end of said annular diaphragm and to said cylinder, said first annular retainer extending from said annular diaphragm to said plunger internally of the ends of said annular diaphragm.

3. In a closed type hydraulic lash adjuster including a hollow cylinder having an open end and a closed end; an elongated plunger having an inner end slidably arranged in said cylinder and an outer end extending exteriorly thereof; and axially elongated resilient annular diaphragm having a first opening at which a first annular retainer attaches said diaphragm to said plunger outer end and a second opening at the other end at which a second retainer attaches said diaphragm to said cylinder adjacent the open end thereof, means for attaching said diaphragm to said plunger outer end comprising:

said first retainer being axially elongated and having its upper end connecting said diaphragm in concentrically spaced relation from said first opening;

a first annular shouldered recess on said plunger adjacent said outer end thereof seating said diaphragm at said first opening; and a second annular shouldered recess on said plunger spaced axially inwardly from said first shouldered recess and receiving the other end of said first retainer in locked engagement with said plunger.

* * * * *